US007121099B2

(12) United States Patent
Shimizu et al.

(10) Patent No.: US 7,121,099 B2
(45) Date of Patent: Oct. 17, 2006

(54) STIRLING REFRIGERATOR AND METHOD OF CONTROLLING OPERATION OF THE REFRIGERATOR

(75) Inventors: Katsumi Shimizu, Takatsuki (JP); Naoki Nishi, Naga-Gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 215 days.

(21) Appl. No.: 10/451,954

(22) PCT Filed: Dec. 25, 2001

(86) PCT No.: PCT/JP01/11402

§ 371 (c)(1),
(2), (4) Date: Jun. 27, 2003

(87) PCT Pub. No.: WO02/053991

PCT Pub. Date: Jul. 11, 2002

(65) Prior Publication Data

US 2004/0055314 A1 Mar. 25, 2004

(30) Foreign Application Priority Data

Dec. 27, 2000 (JP) ..... 2000-396746
Jan. 22, 2001 (JP) ..... 2001-012602

(51) Int. Cl.
*F25B 9/00* (2006.01)
*F25B 9/14* (2006.01)

(52) U.S. Cl. ..... 62/6; 62/190

(58) Field of Classification Search ..... 62/6, 62/520, 190; 324/207.11, 207.12, 207.13
See application file for complete search history.

(56) References Cited

U.S. PATENT DOCUMENTS 3,913,339 A * 10/1975 Berry ..... 62/6
4,389,849 A * 6/1983 Gasser et al. ..... 62/6
4,397,155 A * 8/1983 Davey ..... 62/6
4,543,793 A * 10/1985 Chellis et al. ..... 62/6

(Continued)

FOREIGN PATENT DOCUMENTS

JP 61-153348 A 7/1986

(Continued)

OTHER PUBLICATIONS

Stolfi et al., "Parametric Testing of a Linearly Driven Stirling Cryogenic Refrigerator," Proceedings of the Cryocooler Conference, vol. Conf. 3, pp. 80-98, Sep. 17-18, 1984.

*Primary Examiner*—Cheryl Tyler
*Assistant Examiner*—Richard L. Leung
(74) *Attorney, Agent, or Firm*—Birch, Stewart, Kolasch & Birch, LLP

(57) ABSTRACT

In a Stirling cycle refrigerator, or in a method for controlling the operation of a Stirling cycle refrigerator, when it starts or stops being operated, or according to the detection result from position or temperature detecting means, the voltage supplied to a driving power source for driving a piston is controlled appropriately to prevent the piston from moving too far out of its movable range and thereby prevent breakage of a component resulting from collision between the piston and a displacer.

9 Claims, 11 Drawing Sheets

U.S. PATENT DOCUMENTS

| | | | | | |
|---|---|---|---|---|---|
| 5,022,229 | A | * | 6/1991 | Vitale | 62/6 |
| 5,088,288 | A | * | 2/1992 | Katagishi et al. | 62/6 |
| 5,156,005 | A | * | 10/1992 | Redlich | 62/6 |
| 5,245,830 | A | | 9/1993 | Aubrun et al. | |
| 5,496,153 | A | | 3/1996 | Redlich | |
| 5,502,968 | A | | 4/1996 | Beale | |
| 5,535,593 | A | * | 7/1996 | Wu et al. | 62/6 |
| 5,736,854 | A | * | 4/1998 | Zuger | 324/207.12 |
| 6,050,092 | A | | 4/2000 | Genstler et al. | |
| 6,094,912 | A | * | 8/2000 | Williford | 60/520 |

FOREIGN PATENT DOCUMENTS

| | | | | |
|---|---|---|---|---|
| JP | 63-143370 | A | | 6/1988 |
| JP | 63-143371 | A | | 6/1988 |
| JP | 4-335965 | A | | 11/1992 |
| JP | 04335965 | A | * | 11/1992 |
| JP | 6-74588 | A | | 3/1994 |
| JP | 6-89960 | B2 | | 11/1994 |
| JP | 8-5178 | A | | 1/1996 |
| JP | 08005178 | A | * | 1/1996 |
| JP | 10-253184 | A | | 9/1998 |
| JP | 11-6659 | A | | 1/1999 |
| JP | 11-304270 | A | | 11/1999 |
| JP | 2000-199653 | A | | 7/2000 |
| JP | 2000-304366 | A | | 11/2000 |

* cited by examiner

FIG. 11 "CONVENTIONAL ART"
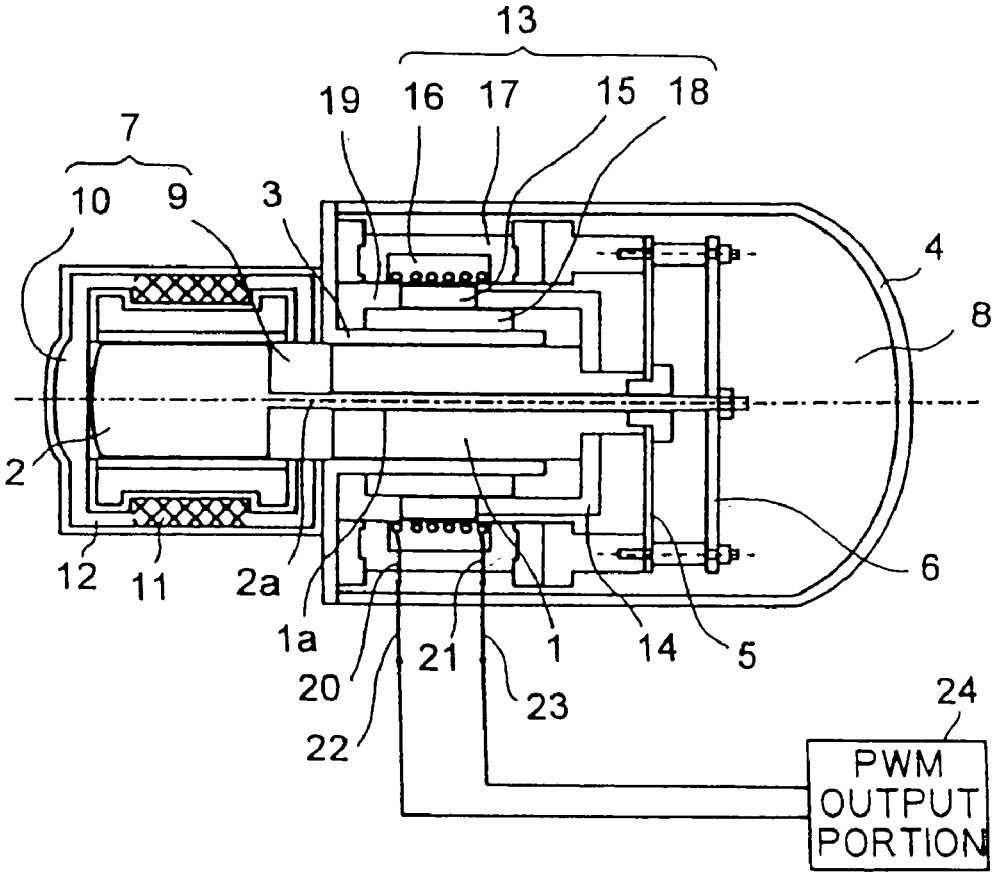

FIG. 12 "CONVENTIONAL ART"
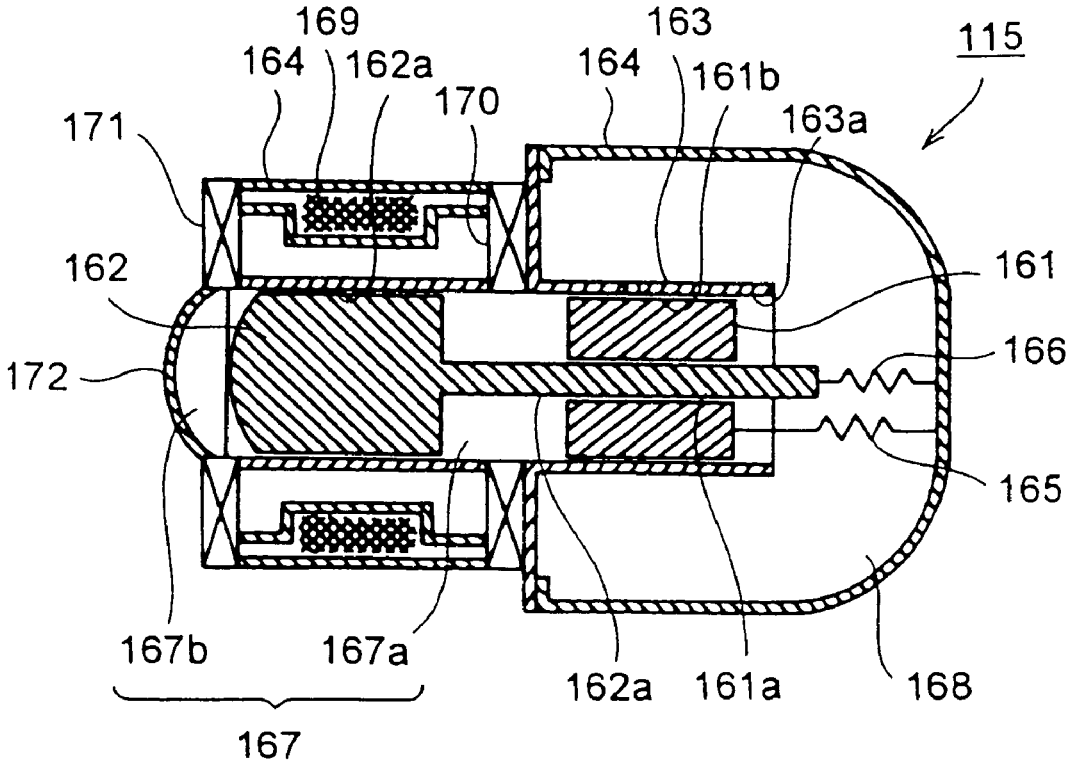

STIRLING REFRIGERATOR AND METHOD OF CONTROLLING OPERATION OF THE REFRIGERATOR

This application is the national phase under 35 U.S.C. § 371 of PCT International Application No. PCT/JP01/11402 which has an International filing date of Dec. 25, 2001, which designated the United States of America.

1. Technical Field

The present invention relates to a Stirling cycle refrigerator, and particularly to a free-piston-type Stirling cycle refrigerator. The present invention relates also to a method for controlling the operation of such a Stirling cycle refrigerator.

2. Background Art

A Stirling cycle refrigerator is a refrigerating system that is designed to offer the desired cooling performance by exploiting a thermodynamic cycle known as the reversed Stirling cycle. In particular, free-piston-type Stirling cycle refrigerators are relatively easy to design and offer excellent performance, and therefore their development has been quite active in these days with a view to putting them into practical use.

FIG. 11 is a sectional view of an example of a conventional free-piston-type Stirling cycle refrigerator. First, the structure of this Stirling cycle refrigerator will be described. Inside a cylinder 3 formed substantially in the shape of a cylinder, a piston 1 and a displacer 2, both formed in the shape of a cylinder, are arranged coaxially. The piston 1 is elastically supported on a pressure vessel 4 by a piston support spring 5.

On the other hand, the displacer 2 has a rod 2*a* formed so as to extend from a central portion thereof toward the piston 1, and this rod 2*a* is put through a slide hole 1*a* formed so as to axially penetrate a central portion of the piston 1. The displacer 2 is elastically supported on the pressure vessel 4 by a displacer support spring 6 placed between the tip of the rod 2*a* and the pressure vessel 4. Between the rod 2*a* and the slide hole 1*a*, a gap is secured to permit the rod 2*a* to slide smoothly without friction. This gap, however, is made as small as possible to minimize the passage of working gas.

The space formed inside the pressure vessel 4 by the cylinder 3 is divided into two spaces by the piston 1. One of these spaces is a working space 7 formed on the displacer 2 side of the piston 1, and the other is a back space 8 formed opposite to the displacer 2. The working space 7 is further separated into a compression space 9 and an expansion space 10 by the piston 1 and the displacer 2. The compression and expansion spaces 9 and 10 are connected together by a passage 12 so as to communicate with each other. In this passage 12 is arranged a regenerator 11 filled with a filling (matrix) such as metal mesh. A predetermined amount of working gas is sealed in the pressure vessel 4.

To that side of the piston 1 opposite to the displacer 2 is coupled a sleeve 14 made of a non-magnetic material and formed so as to have an L-shaped section, and to the other end of the sleeve 14 is fitted an annular permanent magnet 15 along the direction in which the piston 1 slides. Thus, inside a gap 19 between an outer yoke 17 enclosing a driving coil 16 and formed so as to have a C-shaped section and an inner yoke 18 fitted around the outer surface of the cylinder 3, the annular permanent magnet 15 slides along the axis of the cylinder 3 in synchronism with the reciprocating movement of the piston 1.

To the driving coil 16, a first lead 20 and a second lead 21 are connected. These leads 20 and 21 are connected, through the wall of the pressure vessel 4 and via a first and a second electric contact 22 and 23, to a PWM output portion 24. The annular permanent magnet 15, the driving coil 16, the leads 20 and 21, and the yokes 17 and 18 together constitute a linear motor 13. The PWM output portion 24 feeds the linear motor 13 with alternating-current electric power in the form of a pulse voltage.

How the conventional refrigerator structured as described above operates will be described. When the PWM output portion 24 supplies alternating-current electric power via the electric contacts 22 and 23 and by way of the leads 20 and 21 to the driving coil 16, the driving coil 16 produces a magnetic field of which the polarities at both ends change at the frequency of the alternating current. In the gap 19, this magnetic field with changing polarities interacts with the annular permanent magnet 15, and causes attracting and repelling forces to act on the annular permanent magnet 15 along the axis of the cylinder 3. As a result, the piston 1, to which the annular permanent magnet 15 is fitted, moves axially inside the cylinder 3.

Suppose that the driving coil 16 is fed with alternating-current electric power having a sinusoidal waveform. Then, the piston 1 reciprocates by sliding along the inner wall of the cylinder 3. As a result, the working gas in the compression space 9 is compressed, passes through the regenerator 11, where the heat of the working gas is collected, and moves to the expansion space 10. The working gas that has flowed into the expansion space 10 presses the displacer 2 and is expanded.

As the displacer 2 is pushed back by the resilient force of the displacer support spring 6, the working gas is pressed out in the opposite direction, passes through the regenerator 11, where the working gas receives the heat collected by the regenerator 11 a half cycle ago, and returns to the compression space 9.

In this way, the reversed Stirling cycle is formed, in which the variation in the pressure of the working medium compressed and expanded in the working space 7 causes the piston 1 and the displacer 2 to resonate with a phase difference of, typically, 90° relative to each other according to the spring constants of the piston support spring 5 and the displacer support spring 6, respectively.

However, during the operation of the refrigerator, if the pressure of the working gas varies abnormally, or the proper gas balance is lost, the piston 1 may move beyond the tolerated amplitude as designed, i.e. out of its permitted range of movement. In the worst case, the piston 1 may collide with the displacer 2 reciprocating with the aforementioned phase difference relative thereto, leading to breakage of a component.

Therefore, in the operation of a free-piston-type Stirling cycle refrigerator, the alternating-current electric power that is fed to the linear motor 13 needs to be controlled carefully so that the piston 1 does not move beyond the tolerated amplitude.

FIG. 12 is a side sectional view of another example of a conventional free-piston-type Stirling cycle refrigerator.

The Stirling cycle refrigerator 115 has a piston 161 and a displacer 162 linearly reciprocating inside a cylinder 163. The piston 161 and the displacer 162 are arranged coaxially. The displacer 162 has a rod 162*a* formed so as to extend therefrom and penetrate through a slide hole 161*a* formed in a central portion of the piston 161. The piston 161 and the displacer 162 can slide smoothly along an inner slide surface 163*a* of the cylinder 163. The piston 161 and the displacer 162 are elastically supported on a pressure vessel 164 by a piston support spring 165 and a displacer support spring 166, respectively.

The space formed by the cylinder 163 is divided into two spaces by the piston 161. One of these spaces is a working space 167 located on the displacer 162 side of the piston 161, and the other is a back space 168 located on that side of the piston 161 opposite to the displacer 162. Working gas such as pressurized helium gas is sealed in these spaces. The piston 161 is made to reciprocate with a predetermined period by an unillustrated piston driver such as a linear motor. Thus, the working gas inside the working space 167 is compressed and expanded.

The variation in the pressure of the working gas compressed and expanded in the working space 167 causes the displacer 162 to reciprocate linearly. The piston 161 and the displacer 162 are designed to reciprocate with a predetermined phase difference and with an identical period. Here, the phase difference is determined by the mass of the displacer 162, the spring constant of the displacer support spring 166, and the operation frequency of the piston 161, if the other operation conditions are assumed to be the same.

The working space 167 is further divided into two spaces by the displacer 162. One of these spaces is a compression space 167*a* located between the piston 161 and the displacer 162, and the other is an expansion space 167*b* located at the closed end of the cylinder 163. These two spaces are coupled together through a heat rejector 170, a regenerator 169, and a chiller 171. The working gas in the expansion space 167*b* produces cold at a cold head 172 located at the closed end of the cylinder 163. The principles of the working of the reversed Stirling refrigerating cycle, such as how it produces cold, is well known, and therefore their explanations will be omitted.

Here, gas bearings are used as bearing mechanisms between the piston slide surface 161*b* and the cylinder slide surface 163*a* and between the displacer slide surface 162*a* and the cylinder slide surface 163*a*. The bearing effect of these gas bearings results from the working gas compressed by the reciprocating movement of the piston 161 filling the gap between the piston 161, the displacer 162, and the cylinder 163 and thereby permitting their slide surfaces slide without making contact with each other.

Japanese Patent Application Laid-Open No. H7-180919 discloses a method of starting the operation of a crank-type Stirling cycle refrigerator. According to this method, the frequency and the voltage are controlled linearly from the very start of the operation of the Stirling cycle refrigerator so as to prevent excessive current at the start of operation.

However, with a free-piston-type Stirling cycle refrigerator 115 as shown in FIG. 12, in which the spring constant of the displacer support spring 166 and the masses of the displacer 162 and the displacer support spring 166 are so set as to produce resonance at the optimally tuned frequency at which the maximum cooling performance is obtained, starting its operation at previously set fixed frequency and voltage from the start results in greatly missing the resonance point. This causes abnormal oscillation and thus breakage of the Stirling cycle refrigerator 115.

Moreover, for example, when a refrigerator-freezer apparatus incorporating the free-piston-type Stirling cycle refrigerator 115 has just been installed, and thus the temperature inside the apparatus is close to normal temperature, starting the operation of the refrigerator puts a heavy load on it. Thus, if an excessive input is fed to the refrigerator to make it operate at high power immediately after it starts operating, since the pressure of the working gas has not yet come into a steady state (in which the heat rejector 170 and the chiller 171 of the Stirling cycle refrigerator 115 have a predetermined temperature difference), there is a risk of the piston 161 and the displacer 162 interfering and colliding with each other.

When the operation of the free-piston-type Stirling cycle refrigerator 115 is stopped, if the supply of electric power thereto is shut down suddenly, the Stirling cycle refrigerator 115 stops operating suddenly. This causes a large variation in the pressure of the working gas, and therefore there is a risk of the piston 161 and the displacer 162 interfering and colliding with each other.

When the cooling performance of the free-piston-type Stirling cycle refrigerator 115 is adjusted, typically the voltage applied to the piston 161 is varied. The maximum amplitude of the piston 161 depends on the structure of the refrigerator, and the voltage applied to the piston 161 is controlled by a microcomputer so that the piston 161 does not move beyond the maximum amplitude. However, if the input voltage varies, a voltage higher than the rated maximum voltage may be applied to the piston 161. This causes the piston 161 to move beyond the designed amplitude, and therefore there is a risk of the piston 161 and the displacer 162 interfering and colliding with each other.

Moreover, in the free-piston-type Stirling cycle refrigerator 115 employing gas bearings, the gas bearing effect is not obtained in low-speed or small-amplitude operation. This causes friction between the piston 161 and the cylinder 163 and between the displacer 162 and the cylinder 163 as they slide, and thus shortens the life of the Stirling cycle refrigerator.

DISCLOSURE OF THE INVENTION

An object of the present invention is to provide a free-piston-type Stirling cycle refrigerator that prevents collision between the piston and displacer thereof during the operation of the free-piston-type Stirling cycle refrigerator. Another object of the present invention is to provide a method for controlling the operation of a Stirling cycle refrigerator that ensures a gas bearing effect and that prevents breakage due to abnormal oscillation of the Stirling cycle refrigerator or collision between the piston and displacer thereof.

To achieve the above object, according to the present invention, a Stirling cycle refrigerator provided with a piston that is arranged inside a cylinder and that reciprocates along the axis of the cylinder, a driving power source that drives the piston to reciprocate, an electric power source that supplies electric power to the driving power source, and a displacer that reciprocates inside the cylinder with a phase difference relative to the piston is further provided with position detecting means that detects the piston having moved out of the movable range within which the piston is permitted to reciprocate and control means that reduces the electric power supplied from the electric power source to the driving power source when the position detecting means detects that the piston has moved out of the movable range.

With this structure, when the position detecting means detects the piston having moved out of the movable range within which it is permitted to reciprocate, the control means accordingly reduces the electric power supplied to the driving power source of the piston. This prevents the piston from moving too far out of its movable range and thereby prevents breakage of a component resulting from collision between the piston and the displacer.

According to the present invention, a Stirling cycle refrigerator provided with a piston that is arranged inside a cylinder and that reciprocates along the axis of the cylinder, linear motor that drives the piston to reciprocate, an electric power source that supplies alternating-current electric power to the linear motor, and a displacer that reciprocates inside the cylinder with a phase difference relative to the piston is further provided with a position detecting coil that is arranged on both sides or one side of the linear motor coaxially therewith and that detects a permanent magnet having moved out of the movable range within which the permanent magnet is permitted to reciprocate in a manner interlocked with the reciprocating movement of the piston and a controller that varies the voltage of the alternating-current electric power supplied to the linear motor on detecting an electromotive force appearing in the position detecting coil when the permanent magnet has moved out of the movable range.

With this structure, when the permanent magnet, which moves in a manner interlocked with the reciprocating movement of the piston, moves out of its movable range, the permanent magnet passes by the position detecting coil, causing an electromotive force to appear therein. According to this electromotive force, the controller varies the voltage of the alternating-current electric power supplied to the linear motor of the piston. This prevents the piston from moving too far out of its movable range and thereby prevents breakage of a component resulting from collision between the piston and the displacer.

According to the present invention, in a method for controlling the operation of a Stirling cycle refrigerator provided with a piston that is arranged inside a cylinder, a linear motor that drives the piston to reciprocate, an electric power source that supplies alternating-current electric power to the linear motor, and a displacer that reciprocates inside the cylinder with a phase difference relative to the piston, when a permanent magnet has moved out of the movable range within which it is permitted to reciprocate in a manner interlocked with the reciprocating movement of the piston, on detection of an electromotive force appearing as a result in a position detecting coil that is arranged on both sides or one side of the linear motor coaxially therewith and that detects the permanent magnet having moved out of the movable range of the permanent magnet, the voltage of the alternating-current electric power supplied to the linear motor is varied.

With this method, when the permanent magnet, which moves in a manner interlocked with the reciprocating movement of the piston, moves out of its movable range, the permanent magnet passes by the position detecting coil, causing an electromotive force to appear therein. According to this electromotive force, the voltage of the alternating-current electric power supplied to the linear motor of the piston is varied. This prevents the piston from moving too far out of its movable range and thereby prevents breakage of a component resulting from collision between the piston and the displacer.

According to the present invention, in a method for controlling the operation of a free-piston-type Stirling cycle refrigerator having a piston that reciprocates inside a cylinder by use of a gas bearing and a driving power source that drives the piston, when the Stirling cycle refrigerator starts being operated, the driving power source starts being operated by being fed with a low voltage, and then the voltage is gradually increased up to a predetermined voltage.

In this way, when the Stirling cycle refrigerator starts being operated, by first applying a low voltage thereto and then gradually increasing the voltage up to the predetermined voltage, it is possible to ensure the gas bearing effect, to produce resonance between the piston and the displacer and thereby prevent abnormal oscillation of the Stirling cycle refrigerator, and to prevent breakage resulting from collision between the piston and the displacer.

According to the present invention, in a method for controlling the operation of a free-piston-type Stirling cycle refrigerator having a piston that reciprocates inside a cylinder by use of a gas bearing and a driving power source that drives the piston, before the Stirling cycle refrigerator stops being operated, the voltage applied to the driving power source is gradually reduced to a low voltage, and then the Stirling cycle refrigerator stops being operated.

In this way, before the Stirling cycle refrigerator stops being operated, by first gradually lowering the applied voltage to a low voltage and then stopping the operation of the Stirling cycle refrigerator, it is possible to ensure the gas bearing effect, to produce resonance between the piston and the displacer and thereby prevent abnormal oscillation of the Stirling cycle refrigerator, and to prevent breakage resulting from collision between the piston and the displacer.

According to the present invention, in a method for controlling the operation of a Stirling cycle refrigerator having a chiller, a heat rejector, temperature detecting means fitted individually to the chiller and the heat rejector, a piston that reciprocates inside a cylinder, and a driving power source that drives the piston, the temperature detecting means detects the temperature difference between the chiller and the heat rejector of the Stirling cycle refrigerator when it is not in operation, and, based on the temperature difference, the rate at which to increase the voltage applied to the driving power source when the Stirling cycle refrigerator starts being operated is determined.

In this way, by detecting the temperature difference between the chiller and the heat rejector of the Stirling cycle refrigerator when it is not in operation and increasing, faster the greater the temperature difference, the voltage applied to the driving power source when the Stirling cycle refrigerator starts being operated, it is possible to prevent breakage resulting from collision between the piston and the displacer.

BRIEF DESCRIPTION OF DRAWINGS

FIG. 11 is a sectional view of an example of a conventional free-piston-type Stirling cycle refrigerator.

FIG. 12 is a sectional view of another example of a conventional free-piston-type Stirling cycle refrigerator.

BEST MODE FOR CARRYING OUT THE INVENTION

<<First Embodiment>>

Figure 1:
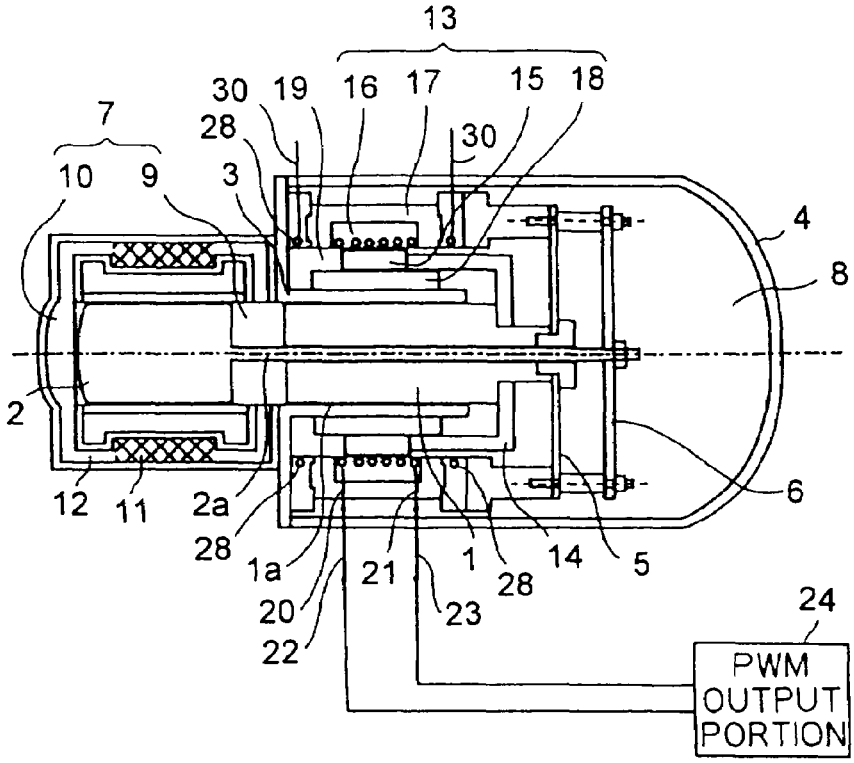
FIG. 1 is a sectional view of an example of a free-piston-type Stirling cycle refrigerator according to the invention.
Figure 2:
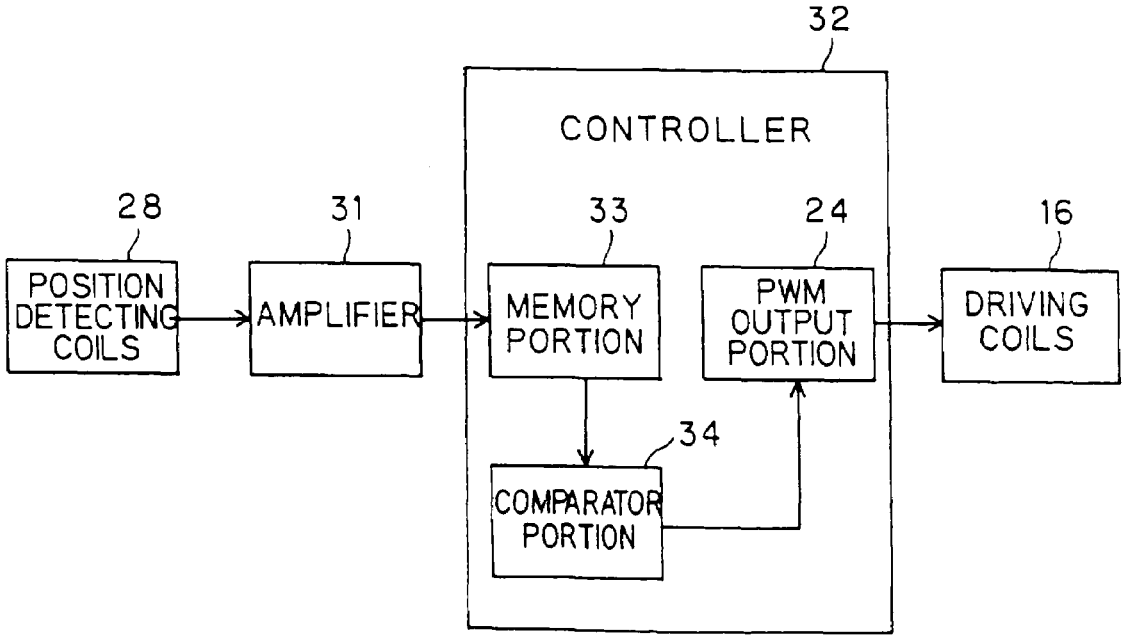
FIG. 2 is a block diagram of the controller of the free-piston-type Stirling cycle refrigerator according to the invention.
Figure 3:
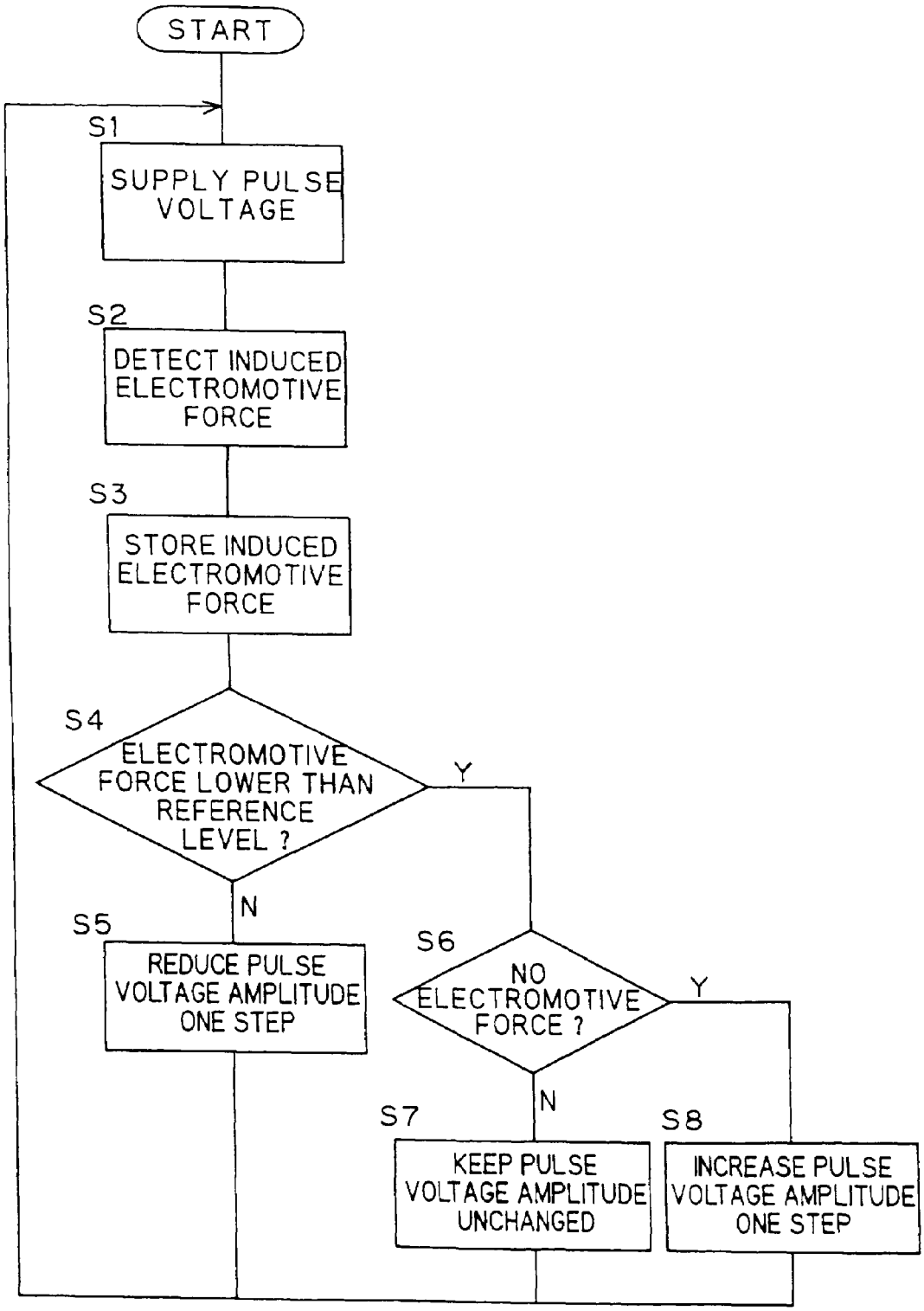
FIG. 3 is a flow chart of an example of the control method of the free-piston-type Stirling cycle refrigerator according to the invention.
Figure 4:
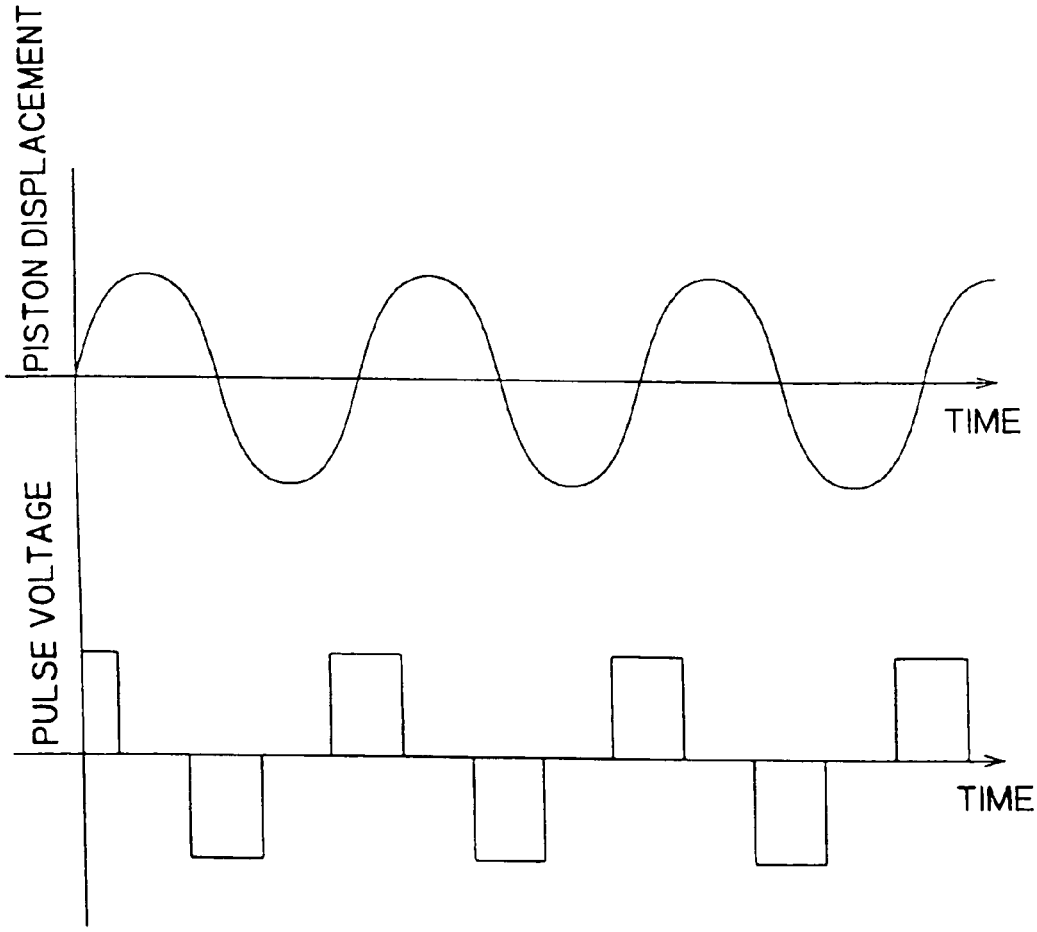
FIG. 4 is a diagram showing the displacement of the piston from the center of its reciprocating movement and the waveform of the pulse voltage fed to the driving coil in the free-piston-type Stirling cycle refrigerator according to the invention.
Figure 5:
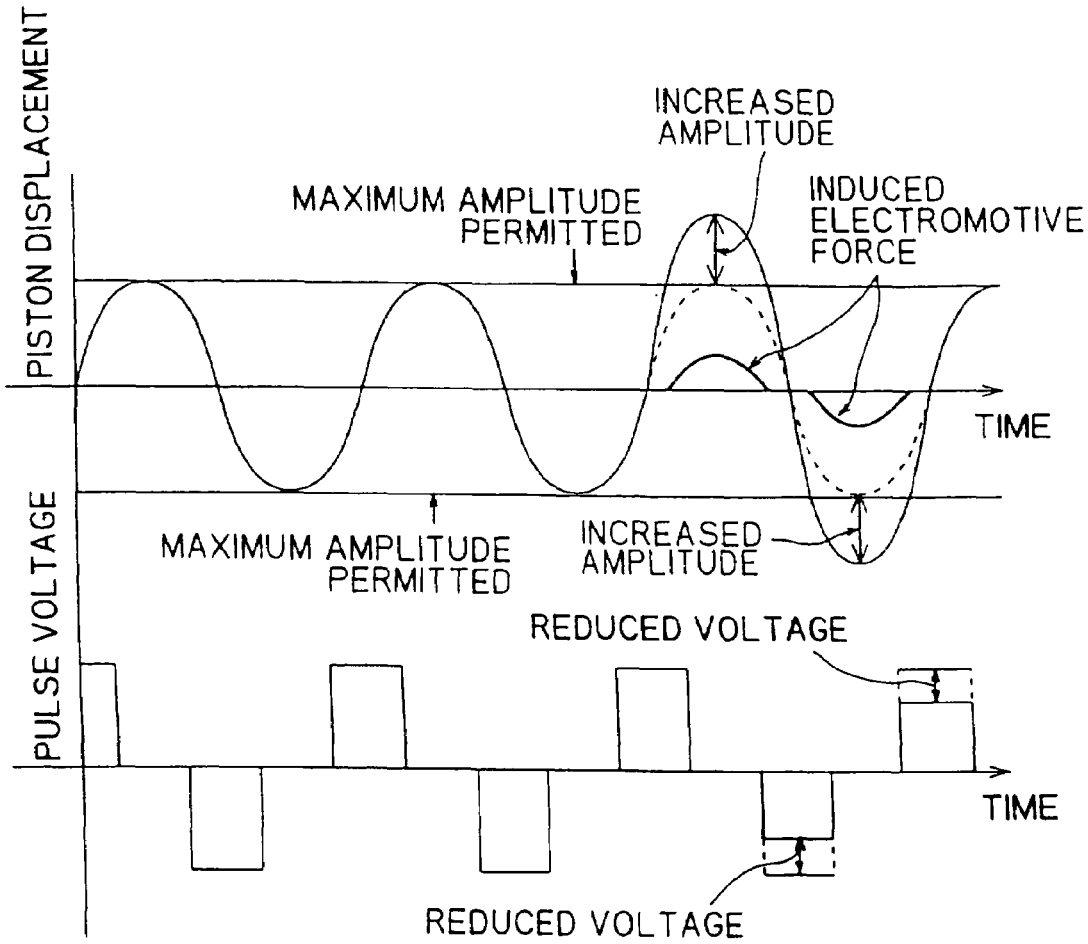
FIG. 5 is a diagram showing the displacement of the piston from the center of its reciprocating movement and the waveform of the pulse voltage fed to the driving coil in the free-piston-type Stirling cycle refrigerator according to the invention.

A first embodiment of the present invention will be described below with reference to the drawings. FIG. 1 is a sectional view of an example of a free-piston-type Stirling cycle refrigerator according to the invention. FIG. 2 is a block diagram of the controller of the refrigerator. FIG. 3 is a flow chart of an example of the control method of the refrigerator. FIGS. 4 and 5 are diagrams showing the displacement of the piston from the center of its reciprocating movement and the waveform of the pulse voltage fed to the driving coil. In FIGS. 1 and 2, such members as are found also in the conventional free-piston-type Stirling cycle refrigerator shown in FIG. 11 and described earlier are identified with the same reference numerals, and their detailed explanations will be omitted.

First, the features unique to the first embodiment will be described with reference to FIGS. 1 and 2. On both sides of the driving coil 16, outside the movable range of the annular permanent magnet 15, a pair of position detecting coils 28 and 28 is provided. These position detecting coils 28 simply need to produce a weak electromotive force induced by a change in the magnetic field, and therefore, to save space, they are each formed as a coil of one to two turns.

From the position detecting coils 28 and 28, leads 30 and 30 are laid through the pressure vessel 4, and are connected through an amplifier 31 to a controller 32. The controller 32 includes a memory portion 33 that receives the detection signal (the induced electromagnetic force) from the position detecting coils 28 and stores it, a comparator portion 34 that compares the voltage stored in the memory portion 33 with a previously set voltage, and a PWM output portion 24 that determines an adequate voltage on the basis of the result of comparison and feeds alternating-current electric power having that voltage to the linear motor 13. The PWM output portion 24 is so configured as to output a pulse voltage (see FIG. 4) of which the amplitude is varied stepwise among a plurality of predetermined levels.

Next, an example of the control method of the free-piston-type Stirling cycle refrigerator structured as described above will be described with reference to FIGS. 1 to 5. When the refrigerator is operating normally, one-to-one correspondence is established between the displacement of the piston 1 from the center of its reciprocating movement and the amplitude of the alternating-current voltage fed from the PWM output portion 24 to the linear motor 13.

However, a sporadic change in the pressure of the working gas or the loss of the proper gas balance causes an irregular change in the undulations of the working gas. As a result, as shown in FIG. 5, the piston 1 may move beyond the tolerated amplitude as designed, i.e. out of its permitted range of movement. In this case, the aforementioned correspondence breaks, and therefore, as long as the alternating-current electric power is kept fed to the linear motor 13 at the same power, it is not possible to restore the increased amplitude of the piston 1 to its original level.

Moreover, with the amplitude of the piston 1 increased, there is even a risk of the piston 1 colliding with the displacer 2, which reciprocates with a phase difference of about 90° relative thereto. This may lead to breakage of a component. When the amplitude of the piston 1 increases in this way, the annular permanent magnet 15, which moves in a manner interlocked with the reciprocating movement of the piston 1, passes inside the position detecting coils 28, and thus causes an induced electromotive force to appear in the position detecting coils 28.

Now, how the refrigerator is controlled in this case will be described in more detail with reference to the flow chart of FIG. 3. In step S1, a pulse voltage (see FIG. 4) with a constant period and a constant amplitude is fed from the PWM output portion 24 to the linear motor 13 so as to make the piston 1 reciprocate with the desired amplitude. At this point, in step S2, the detection of the induced electromotive force appearing in the position detecting coils 28 (FIG. 1) is started. The electromotive force is amplified by the amplifier 31 and is then, in step S3, stored in the memory portion 33 in the controller 32. Then, in step S4, the electromotive force as observed at the moment is compared with a predetermined reference level by the comparator portion 34.

If, in step S4, the electromotive force appearing in the position detecting coils 28 (FIG. 1) is found to be higher than the reference level ("N" in the flow chart), then, in step S5, the amplitude of the pulse voltage fed to the linear motor 13 is set to be one step lower. Then, back in step S1, the pulse voltage, of which the amplitude is now one step lower, is fed from the PWM output portion 24 to the linear motor 13. In this way, it is possible to immediately reduce the amplitude of the reciprocating movement of the piston 1 within its tolerated level.

On the other hand, if, in step S4, the electromotive force is found to be not higher than the reference level ("Y" in the flow chart), then, in step S6, whether the electromotive force is zero or not is checked. If, in step S6, the electromotive force is found to be not zero, then, in step S7, the amplitude of the pulse voltage fed to the linear motor 13 is kept at its current level without being changed. Then, back in step S1, the pulse voltage, of which the amplitude is unchanged, is fed from the PWM output portion 24 to the linear motor 13. In this case, although the piston 1 is reciprocating out of its movable range, there is no risk of its colliding with the displacer 2, and therefore there is no need to bother to change the amplitude of the pulse voltage fed to the linear motor 13.

On the other hand, if, in step S6, the induced electromotive force stored is found to be zero, i.e. no electromotive force is found to have been induced, then it is assumed that the piston 1 is reciprocating within the tolerated amplitude as designed, and therefore, in step S8, the amplitude of the pulse voltage fed to the linear motor 13 is set to be one step higher. Then, back in step S1, the pulse voltage, of which the amplitude is now one step higher, is fed from the PWM output portion 24 to the linear motor 13. In this case, the piston 1 is reciprocating within its movable range, but its amplitude may have lowered from the level at the start of operation for some reason. Therefore, the amplitude of the pulse voltage fed to the linear motor 13 is made one step higher by way of precaution.

In the first embodiment, a pair of position detecting coils 28 and 28 is arranged on both sides of the driving coil 16. The same effect is achieved, however, by arranging a position detecting coil 28 on one side of the driving coil 16, because the amplitude increases in the same manner on both sides as long as the center of the reciprocating movement of the piston 1 remains in a fixed position.

In the first embodiment, there is no need to use a driving power source to drive the displacer. This helps simplify the structure of the Stirling cycle refrigerator as compared with a two-cylinder-type Stirling cycle refrigerator that requires energy to make the displacer reciprocate, and also helps reduce the running costs of the refrigerator in operation.

<<Second Embodiment>>

Next, a second embodiment of the present invention will be described. Here, as a Stirling cycle refrigerator, one with a structure similar to that of the conventional one shown in FIG. 12 is adopted.

Figure 6:
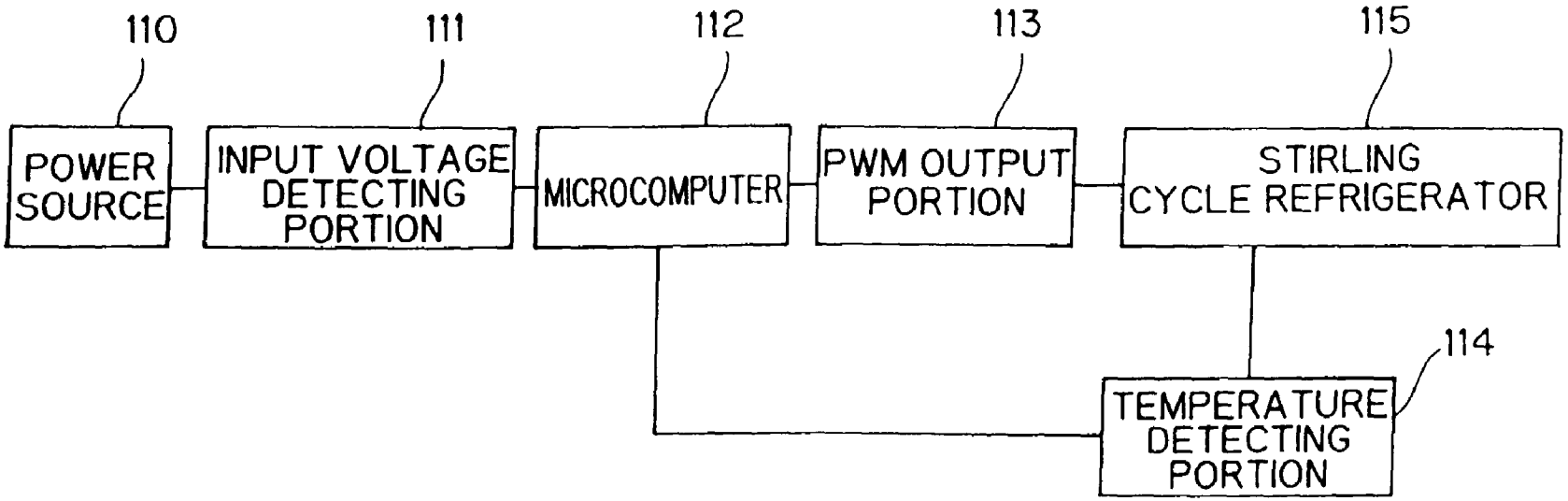
FIG. 6 is a block diagram of the operation controller of a refrigerating apparatus according to the invention.

FIG. 6 shows a block diagram of the operation controller of a refrigerating apparatus provided with a Stirling cycle refrigerator. A voltage supplied from an electric power source 110 is controlled through an input voltage detecting portion 111 by a microcomputer 112, and is then applied through a PWM (pulse width modulation) output portion 113 to a Stirling cycle refrigerator 115. Information on the temperature of the Stirling cycle refrigerator 115 is fed from a temperature detecting portion 114 to the microcomputer 112.

Figure 7:
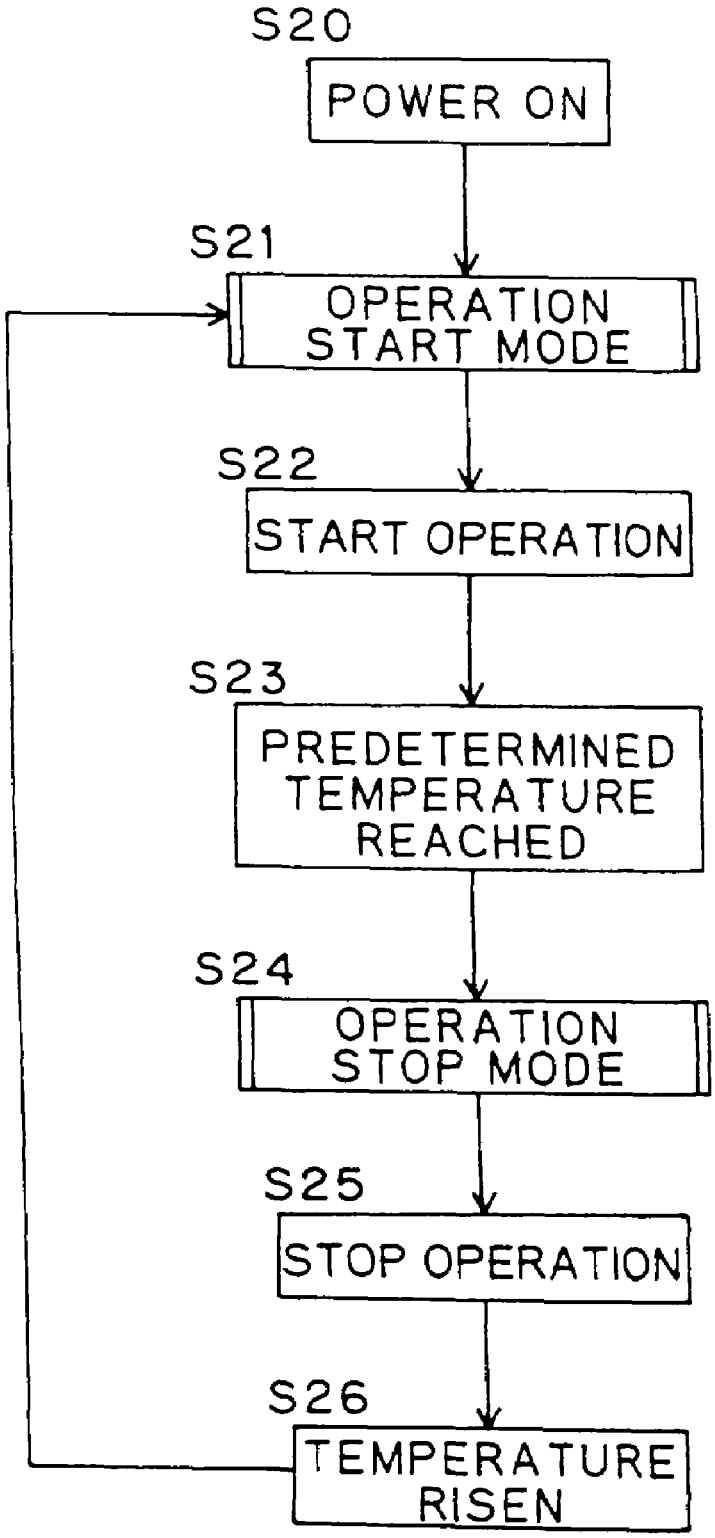
FIG. 7 is a flow chart of the operation control of the refrigerating apparatus according to the invention.

FIG. 7 shows a flow chart of the operation control of the refrigerating apparatus. First, when the supply of power to the refrigerating apparatus is turned on (step S20), the microcomputer 112 executes an operation start mode, whereby, according to the information on the temperature and the like of the Stirling cycle refrigerator 115, the conditions under which to start the Stirling cycle refrigerator 115 (step S21) are determined and then its operation is started (step S22). Next, when the temperature detecting portion 114 detects that the temperature of the refrigerating apparatus has reached a predetermined temperature (step S23), the microcomputer 112 executes an operation stop mode, whereby, under the previously set conditions under which to stop the Stirling cycle refrigerator 115 (step S24), the operation of the Stirling cycle refrigerator 115 (step S25) is stopped. Thereafter, as time passes, when the temperature detecting portion 114 detects that the temperature of the refrigerating apparatus has risen (step S26), the microcomputer 112 executes the operation start mode (step S21) again to restart the operation of the Stirling cycle refrigerator 115. Now, various examples of the second embodiment will be described.

EXAMPLE 1

Example 1 is an example of implementation of the procedure performed in the operation start mode (step S21) shown in FIG. 7 in the second embodiment, i.e. an example of the operation start method of the Stirling cycle refrigerator 115. In the operation start mode (step S21), the piston starts being operated with a voltage previously stored as the lowest voltage that produces resonance between the piston and the displacer of the Stirling cycle refrigerator 115 and that permits the gas bearing to function as such, and then the voltage is increased stepwise, for example, every second in predetermined increments until it reaches a predetermined voltage. Here, the predetermined voltage is usually a voltage determined according to the set temperature, and its maximum value is equal to the voltage determined by the structure of the Stirling cycle refrigerator 115, i.e. the voltage that produces the maximum amplitude of the piston and the displacer.

The voltage fed to the piston at the start of operation may be any voltage higher than the lowest voltage that permits the gas bearing to function as such. However, the higher this voltage is made, the higher the risk of the piston and the displacer interfering and colliding with each other as result of the pressure of the working gas not being in a steady state.

In this operation start method, the voltage may be increased in any other manner than by being increased stepwise in predetermined increments as time passes as described above; for example, the voltage may be increased gradually with a predetermined gradient.

After the temperature of the refrigerating apparatus has reached the set temperature, the Stirling cycle refrigerator 115 may be kept operating, without being stopped, with a somewhat lower voltage fed to the Stirling cycle refrigerator 115 so that the refrigerating apparatus is kept at the set temperature. This helps reduce the frequency of the load put on the Stirling cycle refrigerator 115 when it starts or stops being operated, and thus helps prolong its life.

With this operation start method, it is possible, in a Stirling cycle refrigerator, to ensure the gas bearing effect, to produce resonance between the piston and the displacer and thereby prevent abnormal oscillation of the Stirling cycle refrigerator, and to increase the voltage applied thereto gradually and thereby prevent breakage resulting from collision between the piston and the displacer.

EXAMPLE 2

Example 2 is an example of implementation of the procedure performed in the operation stop mode (step S24) shown in FIG. 7 in the second embodiment, i.e. an example of the operation stop method of the Stirling cycle refrigerator 115. In this operation stop method, the operation of the Stirling cycle refrigerator 115 is stopped by a reversed version of the procedure performed to start its operation in Example 1. Specifically, in the operation stop mode (S24), the voltage is reduced, for example, every second in predetermined decrements until it reaches the lowest voltage that produces resonance between the piston and the displacer and that permits the gas bearing to function as such, and then the voltage is turned to zero.

The voltage may be turned to zero when it becomes equal to any voltage higher than the lowest voltage that permits the gas bearing to function as such. However, the higher the voltage at which the refrigerator is stopped, the greater the change in the pressure of the working gas, and thus the higher the risk of the piston and the displacer interfering and colliding with each other.

In this operation stop method, the voltage may be reduced in any other manner than by being reduced stepwise in predetermined increments as time passes as described above; for example, the voltage may be reduced gradually with a predetermined gradient.

With this operation stop method, it is possible, in a Stirling cycle refrigerator, to ensure the gas bearing effect, to produce resonance between the piston and the displacer and thereby prevent abnormal oscillation of the Stirling cycle refrigerator, and to reduce the voltage applied thereto gradually and thereby prevent breakage resulting from collision between the piston and the displacer.

EXAMPLE 3

Example 3 is an example of implementation of the operation start method of the Stirling cycle refrigerator 115, in which the optimum operation conditions are determined separately by using different procedures between when the operation start mode (step S21) is executed after information on a rise in temperature is given (step S26) in FIG. 7 in the second embodiment and when the operation start mode (step S21) is executed immediately after the supply of power is turned on as in Example 1.

Figure 8:
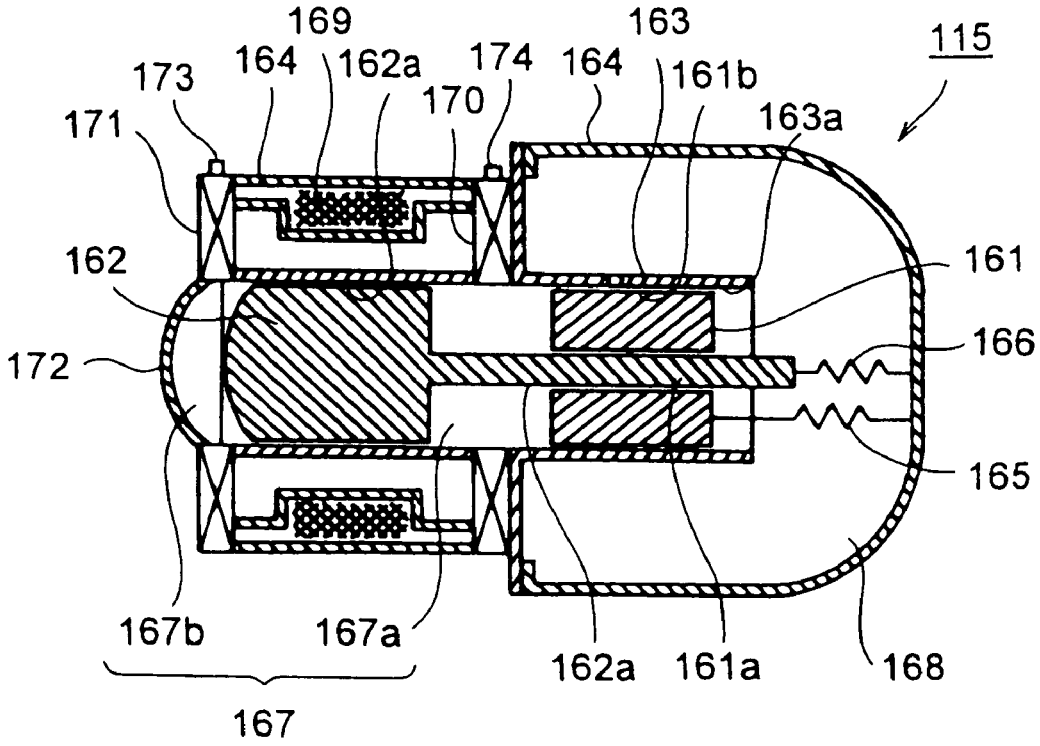
FIG. 8 is a side sectional view of a Stirling cycle refrigerator of Example 3 according to the invention.
Figure 9:
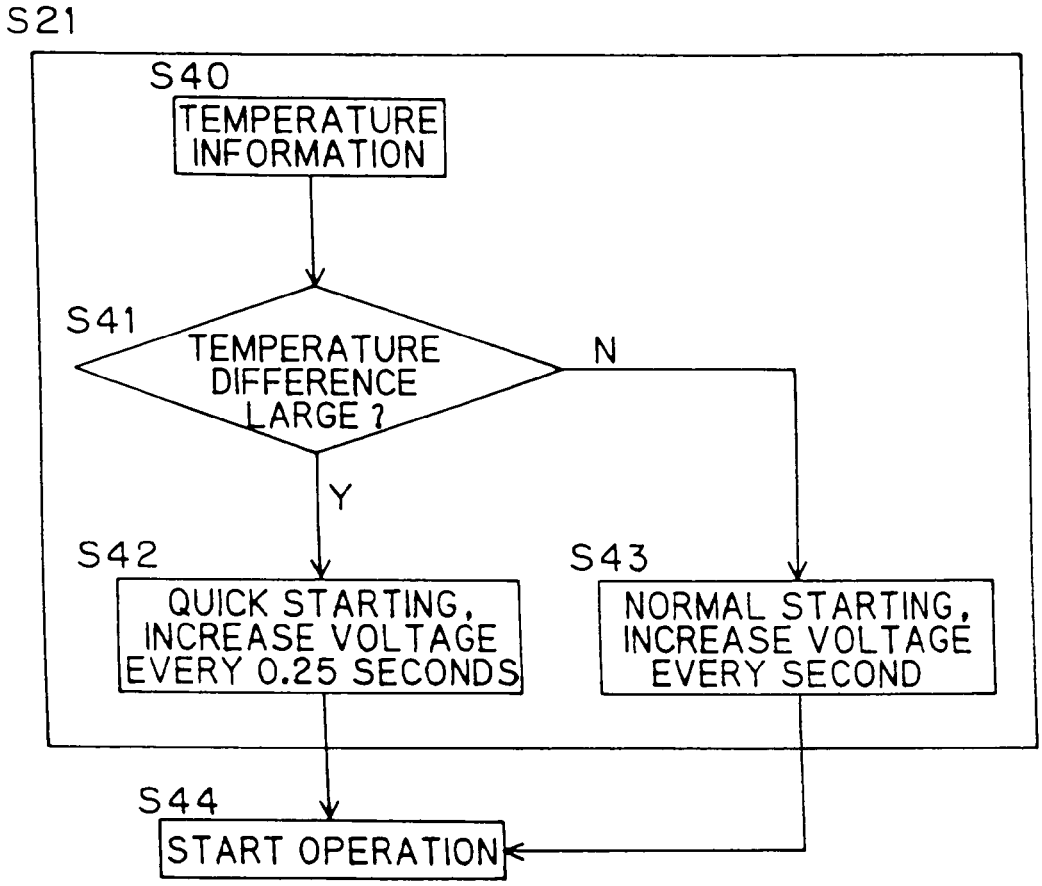
FIG. 9 is a flow chart of the operation start mode in Example 3 according to the invention.

FIG. 8 shows a side sectional view of the Stirling cycle refrigerator of Example 3, and FIG. 9 shows a flow chart of the operation start mode in Example 3. In FIG. 8, such members as are found also in FIG. 12 are identified with the same reference numerals. The chiller 171 and the heat rejector 170 are respectively fitted with, as temperature detecting means, temperature sensors 173 and 174, which are connected to the microcomputer (not shown). The temperatures of the chiller 171 and the heat rejector 170 when the Stirling cycle refrigerator 115 is not in operation are measured, and information on these temperatures is fed to the operation start mode, i.e. to step S21 (step S40). Then, the temperature difference between the chiller 171 and the heat rejector 170 is calculated, and, according to the temperature difference, which operation start method to choose is determined (step S41).

When the temperature difference between the heat rejector 170 and the chiller 171 is large, for example, when only a short period has elapsed after the refrigerator stopped being operated last time, and thus the temperature of the heat rejector 170 is 30° C. and the temperature of the chiller 171 is −20° C., it is judged that quick starting is possible. Thus, the piston starts being operated with the lowest voltage that permits resonance between the piston and the displacer of the Stirling cycle refrigerator 115 and that permits the gas bearing to function as such, and then the voltage is increased at shorter intervals than in Example 1, for example every 0.25 seconds, in predetermined increments until it reaches the predetermined voltage (step S42).

In this way, when the temperatures of the heat rejector 170 and the chiller 171 are close to their temperatures in a steady state, there is no risk of the piston and the displacer interfering and colliding with each other as may occur when the pressure of the working gas is not in a steady state. Thus, the voltage can be increased quickly to attain the set temperature in a short time.

On the other hand, when the temperature difference between the heat rejector 170 and the chiller 171 is small, for example, after the refrigerating apparatus has been out of operation for a long period, such as immediately after its installation or after the supply of power thereto has been shut off, and thus the temperatures of the heat rejector 170 and the chiller 171 are both 20° C., it is judged that normal starting is possible, and therefore the voltage is increased in the same manner as in Example 1 (step S43).

In this way, when the temperatures of the heat rejector 170 and the chiller 171 are close to each other, the refrigerator starts being operated in the same manner as in Example 1 to prevent breakage resulting from collision between the piston and the displacer resulting from the pressure of the working gas not being in a steady state.

Whether the temperature difference between the heat rejector 170 and the chiller 171 is large or small is checked against a predetermined reference value, for example 40° C. Specifically, if the temperature difference is larger than this value, quick starting is chosen and, if it is smaller, normal starting is chosen.

EXAMPLE 4

Example 4 is an example of implementation of the procedure performed by the microcomputer 112 when the input voltage detecting portion 111 detects the input voltage causing the piston to move beyond its maximum amplitude in FIG. 6 in the second embodiment, i.e. an example of the operation control method of the Stirling cycle refrigerator 115. More specifically, in this operation control method, when the detected input voltage is higher than the rated maximum voltage, a voltage lowered down to below the rated maximum voltage is fed to the piston.

Figure 10:
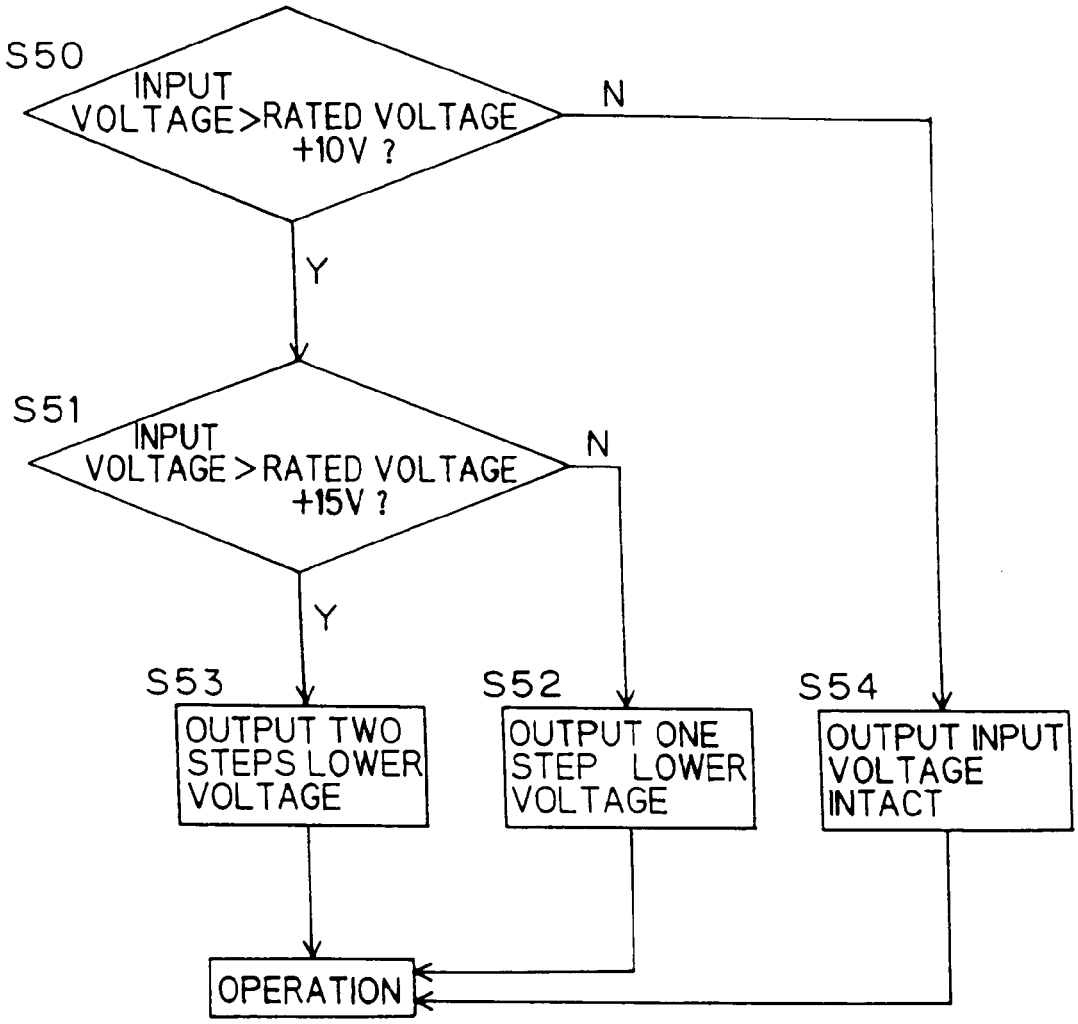
FIG. 10 is a flow chart of the procedure performed by the microcomputer in Example 4 according to the invention.

FIG. 10 shows a flow chart of the procedure performed by the microcomputer 112. Here, how much the input voltage is higher than the rated voltage is calculated, and the voltage is lowered according to the degree of excess. For example, whether or not the input voltage is higher than the rated voltage by 10 V or more is checked (step S50), and, if the excess is 10 V or more, whether or not the input voltage is higher than the rated voltage by 15 V or more is checked (S51). If the excess is less than 15 V, the output voltage is made one step (for example 10 V) lower (step S52). If the excess is 15 V or more, the output voltage is made two steps (for example 20 V) lower (step S53). If the input voltage is found to be higher than the rated voltage by less than 10 V, it is output intact (step S54).

The output voltage may be lowered when it is higher than the rated voltage by any other voltage, as long as it is controlled not to exceed the rated maximum voltage. Moreover, the output voltage may be lowered in any other steps and in any other decrements.

In Example 4, it is also possible to output a voltage lowered down to the rated maximum voltage whenever the input voltage exceeds it.

With this operation control method, it is possible to control the piston so that it does not move beyond its maximum amplitude and thereby prevent breakage resulting from collision between the piston and the displacer.

EXAMPLE 5

Example 4 deals with an operation control method whereby the output voltage is lowered when the input voltage to the microcomputer exceeds the rated voltage or the rated maximum voltage. By contrast, Example 5 deals with a method whereby the output voltage is controlled by detecting the input voltage to the piston and thus the stroke of the piston instead of detecting a variation in the input voltage. For example, after the refrigerator starts being operated, the output voltage, which is commensurate with the stroke of the piston, is detected, and, if the microcomputer 112 detects that this voltage is higher than a voltage previously set in consideration of the maximum amplitude of the piston, the microcomputer 112 recognizes that voltage as the limit of the output voltage, and inhibits the voltage from being increased further.

In this way, it is possible to control the piston so that it does not move beyond its maximum amplitude and thereby prevent breakage resulting from collision between the piston and the displacer.

INDUSTRIAL APPLICABILITY

Stirling cycle refrigerators according to the present invention can be used as refrigerating devices in refrigerating apparatus such as refrigerators, showcases, and vending machines.

The invention claimed is:

1. A Stirling cycle refrigerator comprising a piston that is arranged inside a cylinder and that reciprocates along an axis of the cylinder, a driving power source that drives the piston to reciprocate, an electric power source that supplies electric power to the driving power source, and a displacer that reciprocates inside the cylinder with a phase difference relative to the piston, further comprising:

position detecting means that produces an electromotive force according to a position of the piston;

a comparator portion that compares the electromotive force with a predetermined value; and a controller that reduces the electric power supplied from the electric power source to the driving power source when the electromotive force is higher than the predetermined value, wherein the predetermined value corresponds to a value of the electromotive force that is produced when the piston reciprocates with a permitted maximum amplitude.

2. A Stirling cycle refrigerator comprising a piston that is arranged inside a cylindrical cylinder and that reciprocates along an axis of the cylinder, a linear motor that drives the piston to reciprocate, an electric power source that supplies alternating-current electric power to the linear motor, and a displacer that reciprocates inside the cylinder with a phase difference relative to the piston, further comprising:

a position detecting coil that is arranged on both sides or one side of the linear motor coaxially therewith and that produces an electromotive force according to a position of a permanent magnet moving in a manner interlocked with reciprocating movement of the piston;

a comparator portion that compares the electromotive force with a predetermined value; and a controller that decreases a voltage of the alternating-current electric power supplied from the electric power source to the linear motor when the electromotive force is higher than the predetermined value, wherein the predetermined value corresponds to a value of the electromotive force that is produced when the piston reciprocates with a permitted maximum amplitude.

3. A method for controlling operation of a Stirling cycle refrigerator comprising a piston that is arranged inside a cylinder, a linear motor that drives the piston to reciprocate, an electric power source that supplies alternating-current electric power to the linear motor, and a displacer that reciprocates inside the cylinder with a phase difference relative to the piston, the method comprising:

a step of detecting a position of a permanent magnet that moves in a manner interlocked with reciprocating movement of the piston by reading an electromotive force appearing in a position detecting coil that is arranged on both sides or one side of the linear motor coaxially therewith;

a step of comparing the electromotive force with a predetermined value by a comparator portion; and a step of decreasing a voltage of the alternating-current electric power supplied from the electric power source to the linear motor when the electromotive force is higher than the predetermined value, wherein the predetermined value corresponds to a value of the electromotive force that is produced when the piston reciprocates with a permitted maximum amplitude.

4. A method for controlling operation of a free-piston-type Stirling cycle refrigerator having a piston and a displacer that reciprocates inside a cylinder by use of a gas bearing and a driving power source that drives the piston, the method comprising:

a step of starting operation of the Stirling cycle refrigerator by applying to the driving power source minimal operating voltage that produces resonance between the piston and the displacer and that permits the gas bearing to function; and a step of gradually increasing the voltage being applied to the driving power source from the minimal operating voltage, to a predetermined voltage.

5. A method for controlling operation of a free-piston-type Stirling cycle refrigerator having a piston and a displacer that reciprocates inside a cylinder by use of a gas bearing and a driving power source that drives the piston, the method comprising:

a step of gradually reducing a voltage applied to the driving power source before stopping operation of the Stirling cycle refrigerator; and a step of turning the voltage applied to the driving power source to zero to stop the operation when the voltage reaches a minimal operating voltage that maintains resonance between the piston and the displacer, and that maintains functioning of the gas bearing.

6. A method for controlling operation of a Stirling cycle refrigerator having a chiller, a heat rejector, temperature detecting means fitted individually to the chiller and the heat rejector, a piston that reciprocates inside a cylinder, and a driving power source that drives the piston, wherein the temperature detecting means detects a temperature difference between the chiller and the heat rejector of the Stirling cycle refrigerator when the Stirling cycle refrigerator is not in operation, and, based on the temperature difference, the rate at which to increase the voltage applied to the driving power source when the Stirling cycle refrigerator starts being operated is determined.

7. A free-piston-type Stirling cycle refrigerator comprising:

a cylinder disposed in a pressure vessel;

a piston that is supported at one end thereof by a first elastic body on the pressure vessel along an axis of the cylinder and that is arranged inside the cylinder so as to be driven to reciprocate along the axis of the cylinder;

a driving power source that drives the piston to reciprocate;

an electric power source that supplies electric power to the driving power source;

a displacer that is supported by a second elastic body on the pressure vessel and that reciprocates inside the cylinder; and position detecting means that detects the piston having reciprocated beyond a permitted maximum amplitude, wherein the displacer follows the piston with an identical period and with a phase difference determined by a condition including a mass of the displacer, a spring constant of the second elastic body, and an operating frequency of the piston, and, when the position detecting means detects that the piston has reciprocated beyond the permitted maximum amplitude, an amplitude with which the piston reciprocates is reduced by decreasing the electric power supplied from the electric power source to the driving power source so that the piston is prevented from colliding with the displacer.

8. A free-piston-type Stirling cycle refrigerator as claimed in claim 7, wherein the driving power source is a linear motor;

the electric power supplied from the electric power source is alternating-current; and the position detecting means comprises a permanent magnet that moves in a manner interlocked with reciprocating movement of the piston, and a position detecting coil that is arranged on both sides or one side of the linear motor coaxially therewith so as to produce an electromotive force in accordance with a position of the permanent magnet, wherein, when the electromotive force is higher than a predetermined value, it is determined that the piston reciprocates beyond the permitted maximum amplitude and the electric power supplied to the linear motor is reduced by decreasing a voltage of the electric power source, wherein the predetermined value corresponds to a value of the electromotive force that is produced when the piston reciprocates with the permitted maximum amplitude.

9. A method for controlling operation of a free-piston-type Stirling cycle refrigerator, the free-piston-type Stirling cycle refrigerator comprising:

a cylinder disposed in a pressure vessel;

a piston that is supported at one end thereof by a first elastic body on the pressure vessel along an axis of the cylinder and that is arranged inside the cylinder so as to be driven to reciprocate along the axis of the cylinder;

a linear motor that drives the piston to reciprocate;

an electric power source that supplies alternating-current electric power to the linear motor;

a displacer that is supported by a second elastic body on the pressure vessel and that reciprocates inside the cylinder by following the piston with an identical period and with a phase difference determined by a condition including a mass of the displacer, a spring constant of the second elastic body, and an operating frequency of the piston; and position detecting means comprising a permanent magnet that moves in a manner interlocked with reciprocating movement of the piston, and a position detecting coil that is arranged on both sides or one side of the linear motor coaxially therewith so as to produce an electromotive force in accordance with a position of the permanent magnet, wherein the method for controlling the operation of the free-piston-type Stirling cycle comprises:

a step of judging whether or not the electromotive force produced in the position detecting coil is higher than a predetermined value;

a step of deciding that, when the electromotive force is higher than the predetermined value, the piston has reciprocated beyond a permitted maximum amplitude; and a step of decreasing a voltage of the alternating-current electric power supplied from the electric power source to the linear motor so that the piston is prevented from colliding with the displacer, wherein the predetermined value corresponds to a value of the electromotive force that is produced when the piston reciprocates with the permitted maximum amplitude.

* * * * *